United States Patent [19]

Peterman

[11] 3,946,805

[45] Mar. 30, 1976

[54] UNDERWATER CONNECTIONS AT WELL HEAD LOCATIONS

[75] Inventor: Charles P. Peterman, South Laguna, Calif.

[73] Assignee: Hydril Company, Los Angeles, Calif.

[22] Filed: Apr. 8, 1974

[21] Appl. No.: 458,648

[52] U.S. Cl. ..... 166/.6; 285/27; 285/29

[51] Int. Cl.[2] ..... E21B 7/12

[58] Field of Search ..... 61/72.3; 166/.5, .6; 175/7; 285/18, 24–29

[56] References Cited

UNITED STATES PATENTS

| | | | |
|---|---|---|---|
| 3,199,595 | 8/1965 | Lafitte et al. | 166/.6 |
| 3,302,709 | 2/1967 | Postlewaite | 175/7 X |
| 3,331,437 | 7/1967 | Jones | 166/.6 |
| 3,339,632 | 9/1967 | Lewis | 166/.6 |
| 3,363,683 | 1/1968 | Corley et al. | 166/.5 |
| 3,384,169 | 5/1968 | Leonard | 166/.5 |
| 3,448,799 | 6/1969 | Ahlstone | 166/.5 |
| 3,460,614 | 8/1969 | Burgess | 166/.6 |
| 3,503,219 | 3/1970 | Hovot | 166/.5 |
| 3,550,682 | 12/1970 | Fowler | 166/.6 |
| 3,581,815 | 6/1971 | Murman | 166/.5 |
| 3,633,667 | 1/1972 | Falkner | 166/.5 |
| 3,714,384 | 1/1973 | Burkhardt | 166/.6 |
| 3,766,743 | 10/1973 | Brown | 166/.6 |
| 3,775,986 | 12/1973 | Daughtry | 166/.6 |

*Primary Examiner*—Frank L. Abbott
*Assistant Examiner*—Richard E. Favreau
*Attorney, Agent, or Firm*—William W. Haefliger

[57] ABSTRACT

The establishment of control of a stack of underwater well head equipment is achieved by preliminarily positioning a locating means at the well head, and then:

a. lowering to the well head first and second connector means and effecting reception thereof by the locating means so that the first and second connector means extend in laterally spaced apart relation as determined by the locating means, and b. lowering to the well head crossover third and fourth connector means and effecting generally vertical coupling thereof to the previously located first and second connector means respectively, for operatively interconnecting the first and second connector means via the crossover connector means.

The first connector means typically has control line communication with a surface control station, and the second connector means typically has control communication with equipment in the stack.

21 Claims, 13 Drawing Figures

UNDERWATER CONNECTIONS AT WELL HEAD LOCATIONS

BACKGROUND OF THE INVENTION

This invention relates generally to the control of undersea well head equipment, and more particularly concerns the establishment of electrical and/or fluid pressure connections at sub-sea well head locations.

In the past, considerable difficulties and problems have been encountered in making remote electrical and fluid pressure connections at well heads on the ocean floor. Such connections are required to provide for remote control of the well head equipment such as valves, blowout preventers, accumulators, etc. In certain installations, elaborate procedures have been set up for ensuring alignment and effective interconnection of connectors in response to this relative horizontal movement; however, the equipment to effect such interconnections is complex, and retrieval procedures for such connectors become cumbersome and unreliable.

SUMMARY OF THE INVENTION

It is a major object of the invention to provide method and apparatus characterized as overcoming the above as well as other problems encountered in this environment.

Basically, and as regards the procedure contemplated by the invention, a locating means is positioned at a well head; first and second connector means are then independently lowered to the well head and downwardly received by the locating means to become accurately laterally spaced apart; and crossover third and fourth connectors are then lowered to the well head and vertically coupled to the first and second connectors for operatively interconnecting the latter via the crossover means. In this regard, a control line may extend from the surface to the first connector, and another control line may extend from the second connector to the well head equipment. Since all couplings and interconnections are made in a vertical direction, both make-up and retrieval of the connectors is greatly simplified, and connection dependability enhanced. Both electrical and fluid pressure line connections and couplings, in such vertical modes, are contemplated.

Additional objects of the inventions include the provision of apparatus for independently lowering and retrieving the first and second connectors, as well as the crossover connector means, such apparatus including guides independently lowered on control lines, the provision of retrievable pedestal means to receive the first and second connectors; and the provision of redundant or dual first and second connectors, as will be described.

These and other objects and advantages of the invention, as well as the details of an illustrative embodiment, will be more fully understood from the following description and drawings, in which:

DRAWING DESCRIPTION

DETAILED DESCRIPTION

Figure 1:
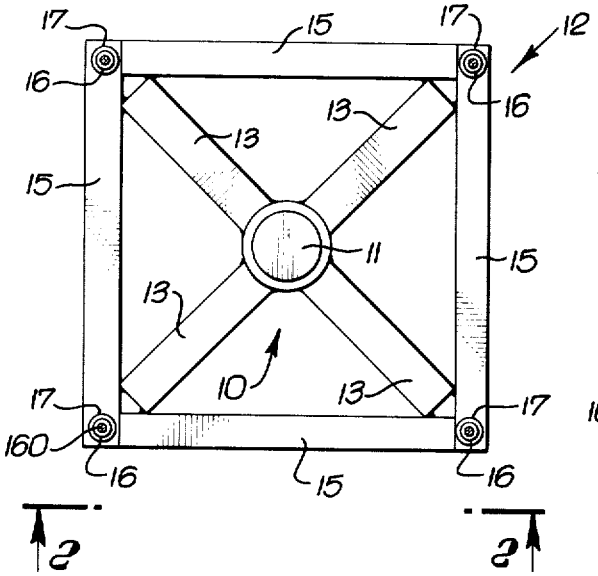
FIG. 1 is a plan view of a sub-sea well head installation.
Figure 3:
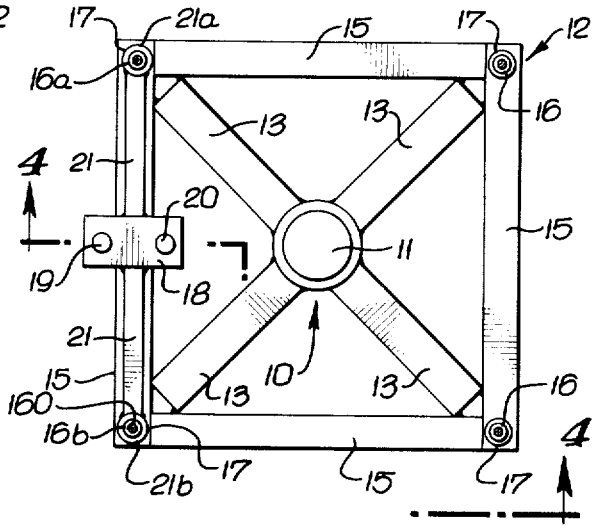
FIG. 3 is a view like FIG. 1, but after predestal means has been installed at the well head.
Figure 2:
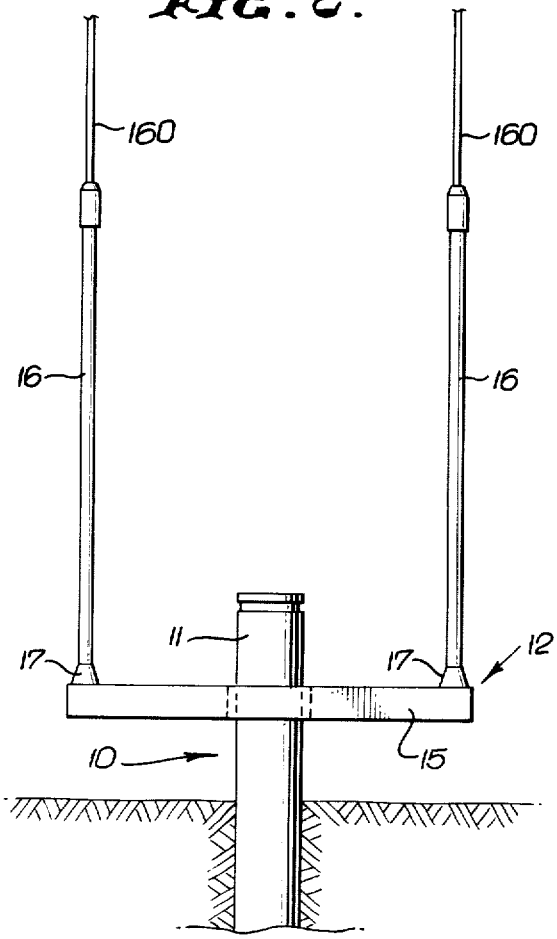
FIG. 2 is a side elevation on lines 2—2 of FIG. 1.

FIGS. 1 and 2 show a sub-sea well head 10 including a stub casing 11 and a horizontal base plate or platform 12 anchored to the casing, as by means of members 13 extending between and connected to the casing and corner intersections of platform members 15. Vertically extending guides including posts 16 and lines 160 are anchored at 17 to the corners of the platofrm structure, it being understood that other forms of platforms and guides may be employed. In this regard, the well head in FIGS. 1 and 2 is awaiting completion operation, in that the production packers have been set, production tubing and hangers have been run, and plugs have been left in the tubing hangers for safety purposes.

Figure 4:
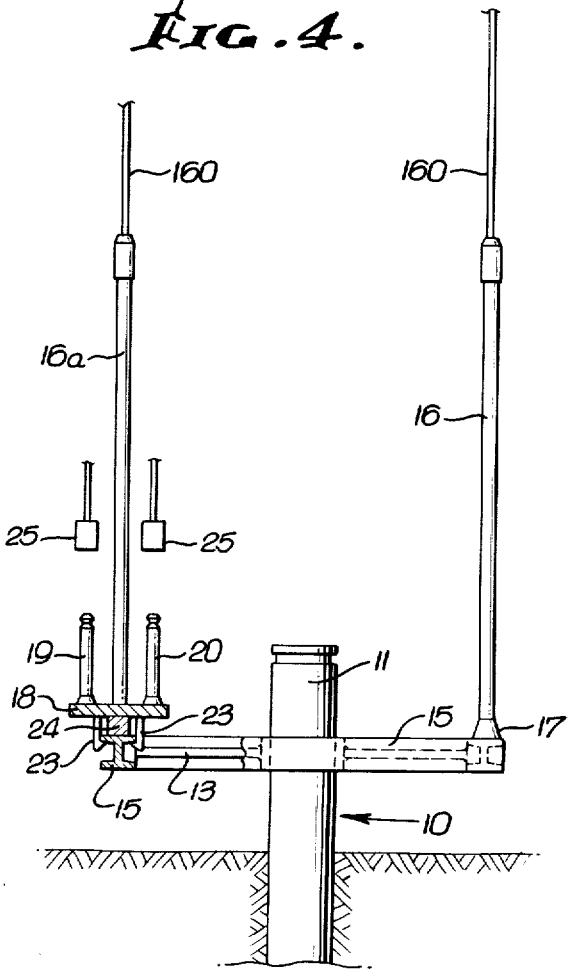
FIG. 4 is a side elevation on lines 4—4 of FIG. 3.

In accordance with the invention, a locating means is positioned at the well head so as to downwardly telescopically receive first and second connector means, to be described. The locating means may typically include structure such as a base 18 and dual locators such as pedestals 19 and 20 thereon and which project upwardly in laterally spaced apart relation to similarly orient the first and second connector means. In this regard, the locating means typically includes guide means for downwardly guiding the described structure, during lowering thereof, into locating position at the well head, and the guide means may comprise arms 21 integral with and extending oppositely from the base 18 for locating the latter generally mid-way between two of the guides **16*a* and 16*b*, to which the arms are operatively coupled. Thus, the arms may form or carry sockets 21*a* and 21*b* guidably or slidably receiving the posts 16*a* and 16*b*, respectively, so that the assembly including the arms, base and pedestals may be lowered to the well head position shown in FIG. 4, near the stub casing. If desired, the base 18 may be removably or otherwise locked to the platform 12 as by means of depending jaws 23 embracing a member 15, as seen in FIG. 4. A spacer 24 on base 18 seats on member 15. A lowering line connection to one or both pedestals is indicated at 25; however, the base 18** may be permanently locked to the platform.

Figure 5:
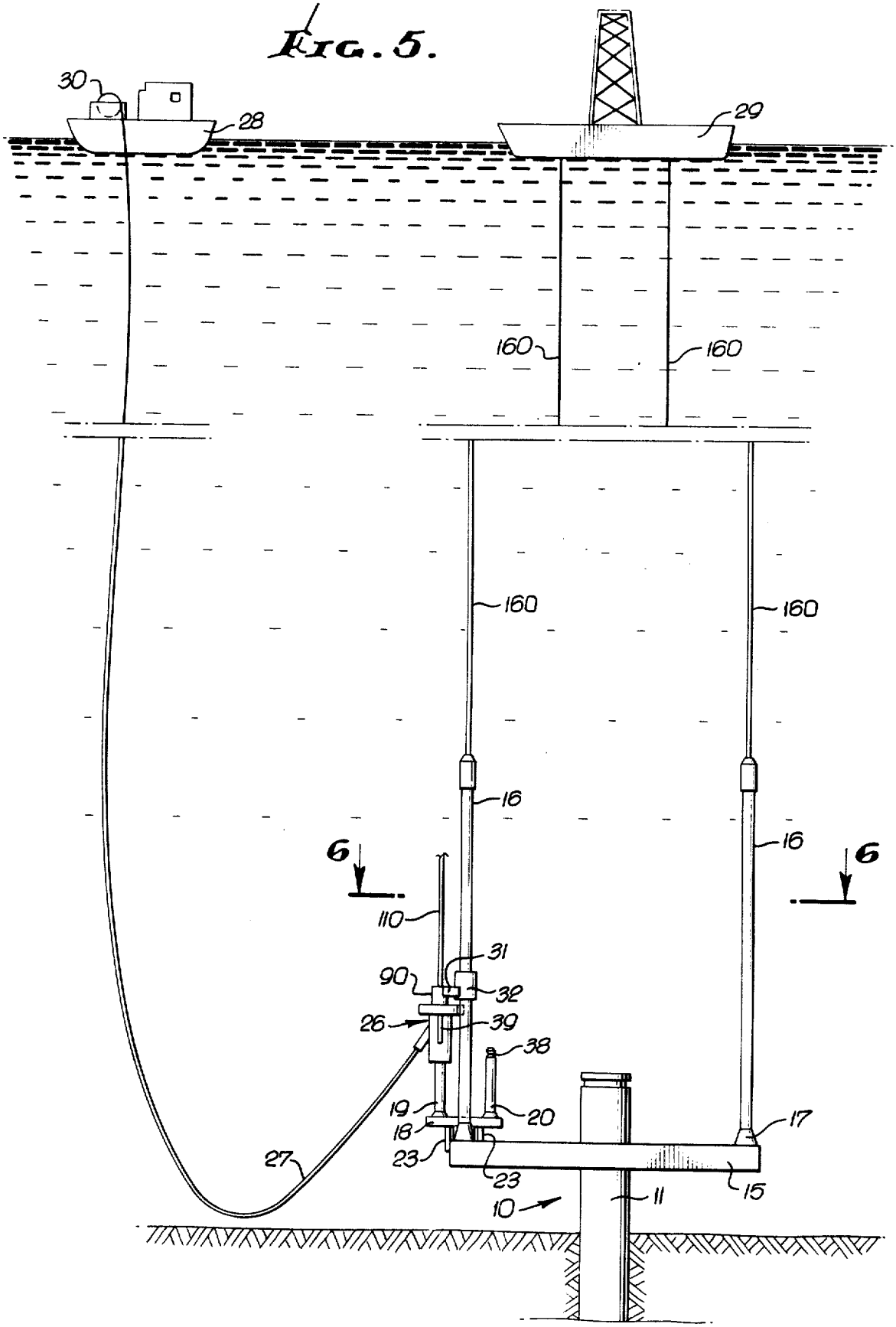
FIG. 5 is a view like FIG. 4, but after further installation of a control connector on the pedestal means.
Figures 6, 13:
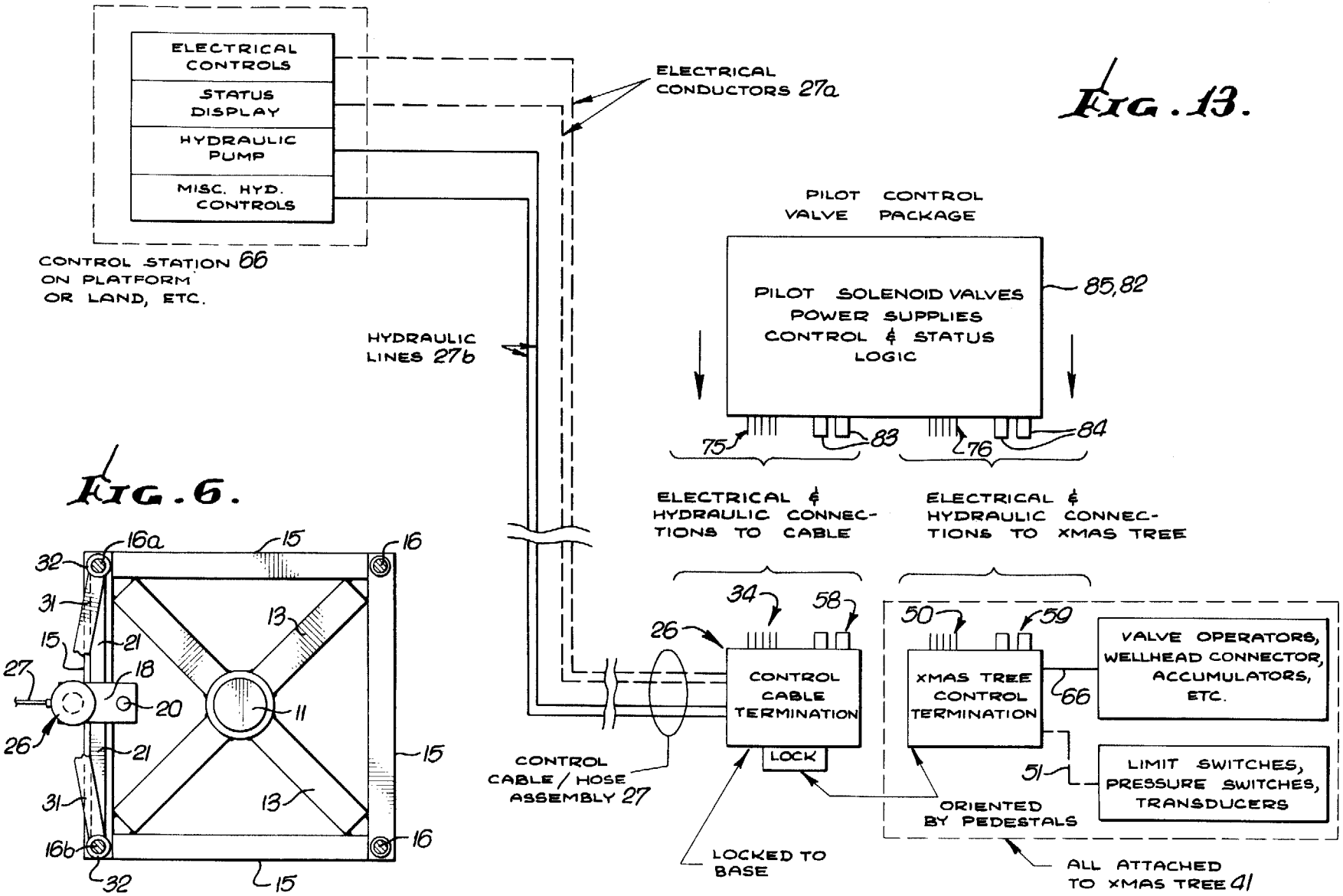
FIG. 6 is a plan view taken on lines 6—6 of FIG. 5.
FIG. 13 is a system block diagram.

Referring now to FIGS. 5 and 6, a first connector means, generally indicated at 26, is next lowered to the well head, with a control line 27 attached, the latter typically extending to a surface barge 28 or vessel other than the usual workover or drilling vessel 29 above the well head. Vessel 28 carries a reel or reels 30 for line 27, which may include an electrical cable **27*a* and/or a fluid pressure hose or conduit 27*b*, as indicated in FIG. 13. A line 110 may be employed to lower the first connector 26, there being a first guide arm or arms 31** attached to a coupling 90 (to be described) carried by line 110 and which releasably couples to the connector nipple 91 to be described. The arms have sockets 32 to slidably interfit the guide line elements 16 and 160.

Figure 11:
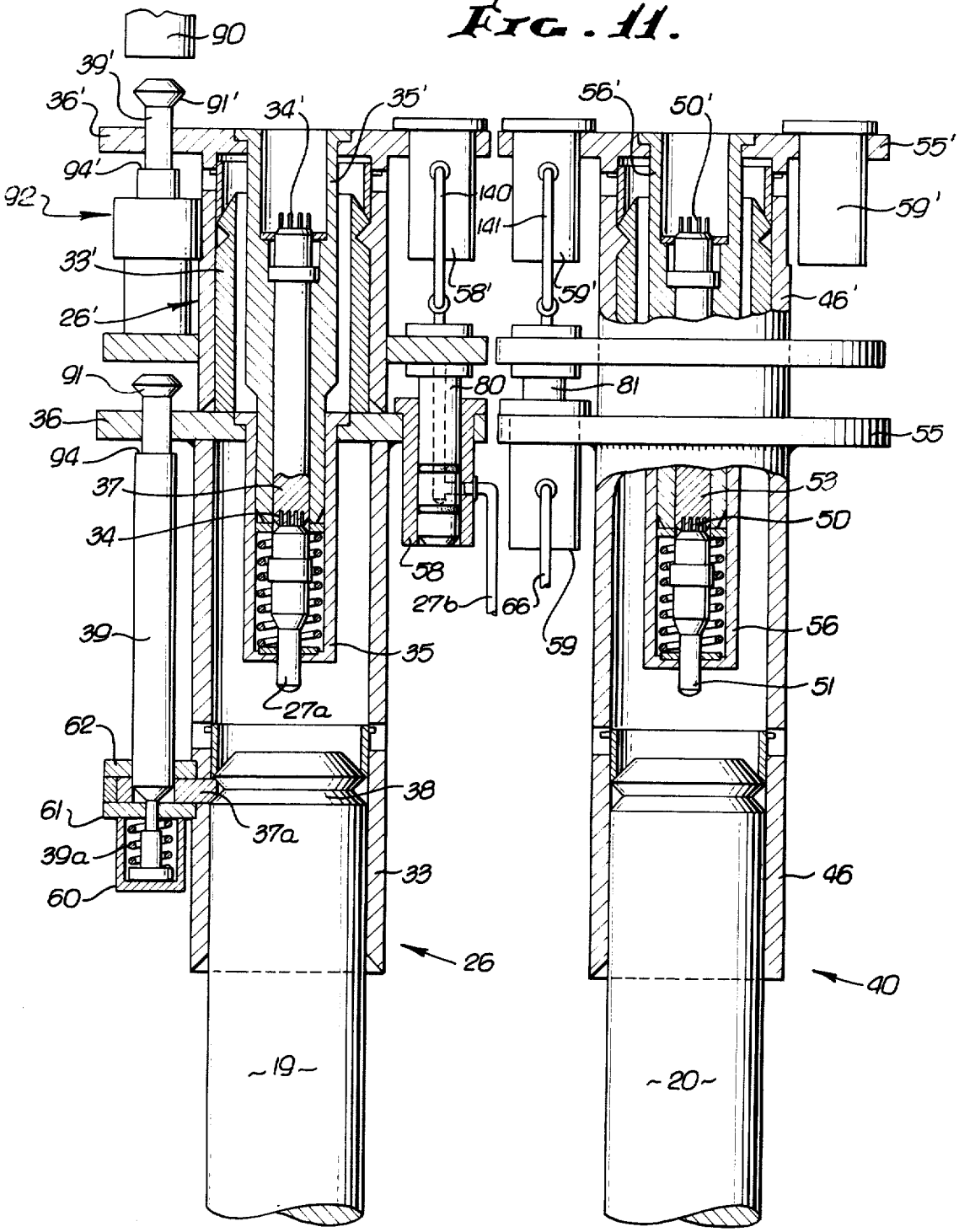
FIG. 11 is an enlarged side elevational showing of the pedestal means and installed connectors.

In the example seen in FIG. 11, the first connector means 26 may include a sleeve 33 which fits downwardly over the locating pedestal, and locks thereon in the manner to be described. Note that the first connector may include a first upwardly presented electrical connector indicated at 34 and at the lower terminus of cable 27*a*. Merely as illustrative, the connector 34 includes upwardly extending plug pins, and is received in a receptacle 35 carried by sleeve 33 via a top mounting plate 36. The first connector may optionally include a dual electrical plug connector indicated at 34', and which has vertically separable telescopic interfit with connector 34, as via socket 37 which receives the latter. Connector 34' is received in a receptacle 35' carried by sleeve 33' via a top mounting plate 36'. Sleeve 33' seats on plate 36, as shown. Accordingly, should the upper connector 34' become inoperable for some reason, the assembly 33', 34', 35' and 36' may be removed upwardly, to disconnect socket 37 from plug 34, exposing the latter for reception of a third electrical connector in the form of a crossover socket element to be described.

Note the provision of a latch 37*a* carried by the connector sleeve 33 to interfit a groove 38 on the pedestal, and to be locked in that position by a locking pin 39 urged downwardly by spring 39*a*. Housing structure for these elements is indicated at 60–62, the pin 39 being yieldably upwardly removable to free the latch for retraction from groove 38. While the connector is being run into latching position, an interior sleeve 125 in lowered position holds latches 37*a* outwardly.

Figure 7:
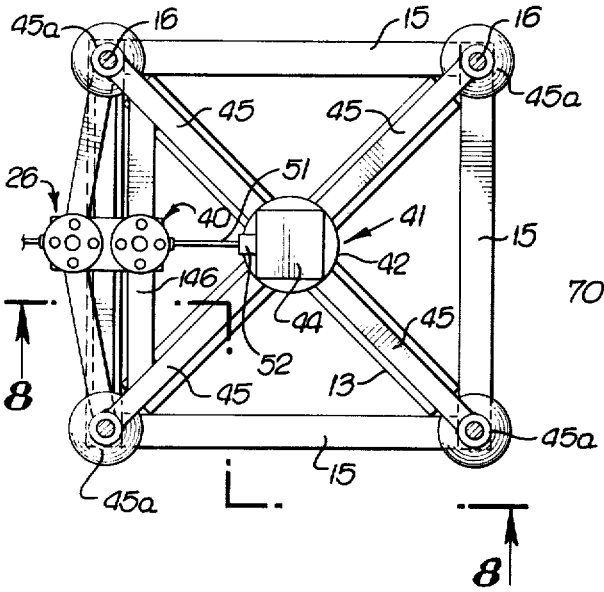
FIG. 7 is a view like FIG. 6 but after further installation of a Christmas Tree at the well head, and associated connector means on the pedestal means.
Figure 8:
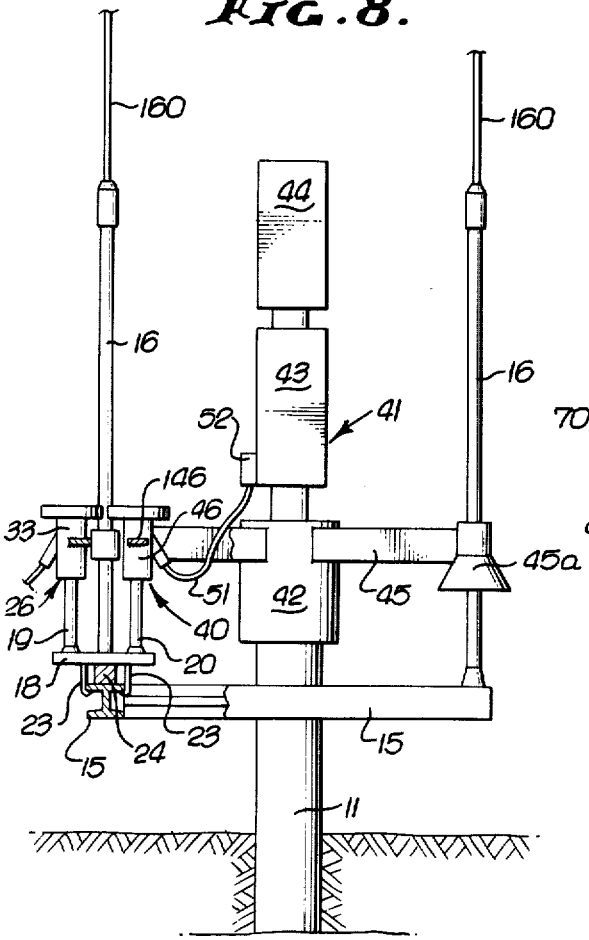
FIG. 8 is a side elevation on lines 8—8 of FIG. 7.

Referring to FIGS. 7 and 8, a second connector means, generally indicated at 40, is next lowered to the well head for removable downwardly telescopic reception by the dual structure, i.e. pedestal 20 in the example, so as to be upwardly retrievable independently of the first connector 26. In this regard, the second connector 40 may be carried or associated with well head equipment, such as a Christmas tree 41 lowered to the well head for attachment onto the stub casing 11, as via a well head connector 42. One example of the latter is described in U.S. Pat. No. 2,962,096 to Knox. The tree 41 may include production valves, blowout preventers, etc. schematically shown at 43 and 44, and guide arms 45 extending outwardly from the tree for guiding on lines 16 as via arm sockets 45*a*. Another arm 146 carries the second connector 40 previously referred to, at a location to telescopically interfit pedestal 20 in the same manner that connector 26 interfits pedestal 19. For example, as seen in FIG. 11, a sleeve 46 associated with connector 40 is received downwardly over the pedestal 20.

Note that the second connector may include a second upwardly presented electrical connector 50 like that at 34, at the terminus of a cable 51 extending to the Christmas tree junction box 52. Connector 50 includes contact or plug pins and is received in a receptacle 56 like that at 35, and suspended by plate 55.

The second connector may also optionally include a dual electrical plug connector indicated at 50', and which has vertically separable telescopic interfit with connector 50 via a socket 53, which receives the pins of plug 50. Connector 50' is received in a receptacle 56' carried by sleeve 46' via a top mounting plate 55'.

Accordingly, should the upper connector 50' become inoperable for any reason, the assembly 46', 50', 55' and 56' may be removed upwardly to disconnect socket 53 from plug 50, exposing the latter for reception of a fourth electrical connector in the form of a crossover socket element to be described. Latching of the second connector 40 in the vertical positions shown is achieved by the well head connector attachment to the stub casing, as previously described, although there may be slight vertical and horizontal play of the second connector sleeve 46 relative to arm 146.

While electrical connections have been described in FIG. 11, it will be understood that fluid pressure connections may also, or alternatively, be established; thus, in FIGS. 11 and 13, first fluid connectors are indicated at 58, and second fluid connectors at 59, and dual fluid connectors 58' and 59' may be respectively associated with connectors 58 and 59 via conduits 140 and 141 in a similar manner as dual electrical connectors 34' and 50' are associated with connectors 34 and 50. Connectors 58 are at the lower terminus of control line 27*b*. Connectors 59 are connected via lines 66 with valve operators, the well head connector 42 and accumulators at the tree 41, and connectors 50 are connected via line 51 with limit switches, pressure switches and transducers at the tree, as seen in FIG. 13.

Figure 9:
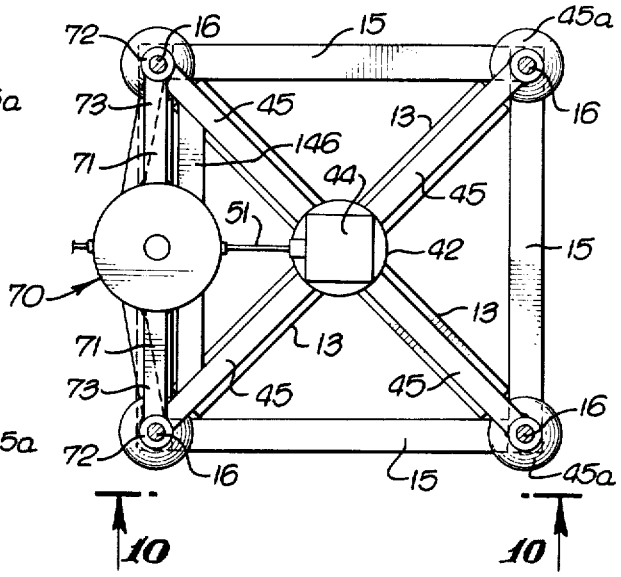
FIG. 9 is a view like FIG. 7 but after further installation of a pilot control valve package on the pedestal oriented connectors.
Figure 10:
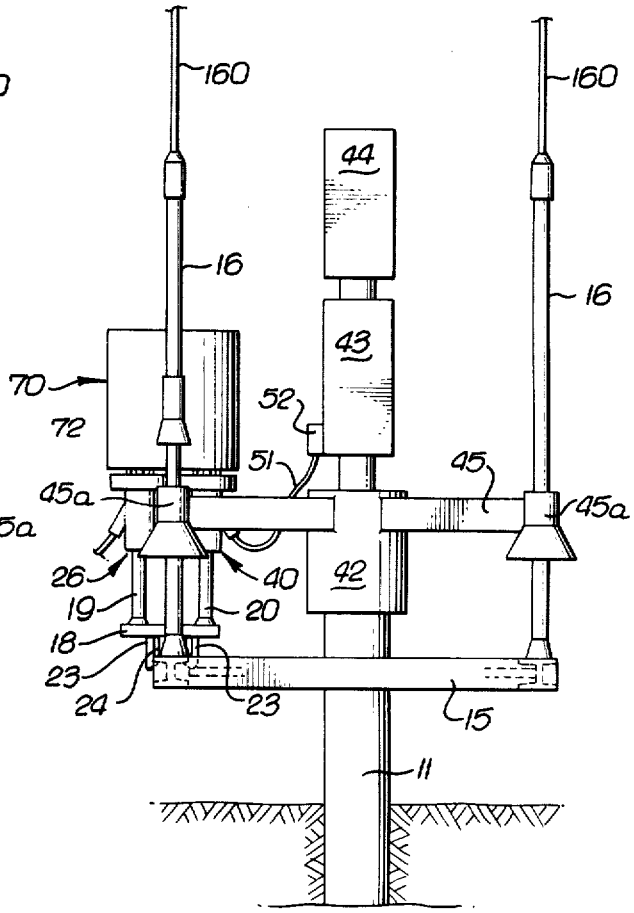
FIG. 10 is a side elevation on lines 10—10 of FIG. 9.

Lastly, third and fourth crossover connector means are lowered to the well head locations and coupled to the first and second connectors, respectively, for operatively interconnecting the latter, thereby establishing control of the Christmas tree equipment from the surface. See in this regard the control station 66 in FIG. 13, and to which the upper terminus of lines 27*a* and 27*b* may be transferred from the barge 28. Such third and fourth connectors means may be carried by the control package 70 seen in FIG. 10, to which guide arms 71 are connected, the arms having end sockets 72 which pass the guides 16. A connection for a lowering line is shown at 73 on arm 71 in FIG. 9.

Figure 12:
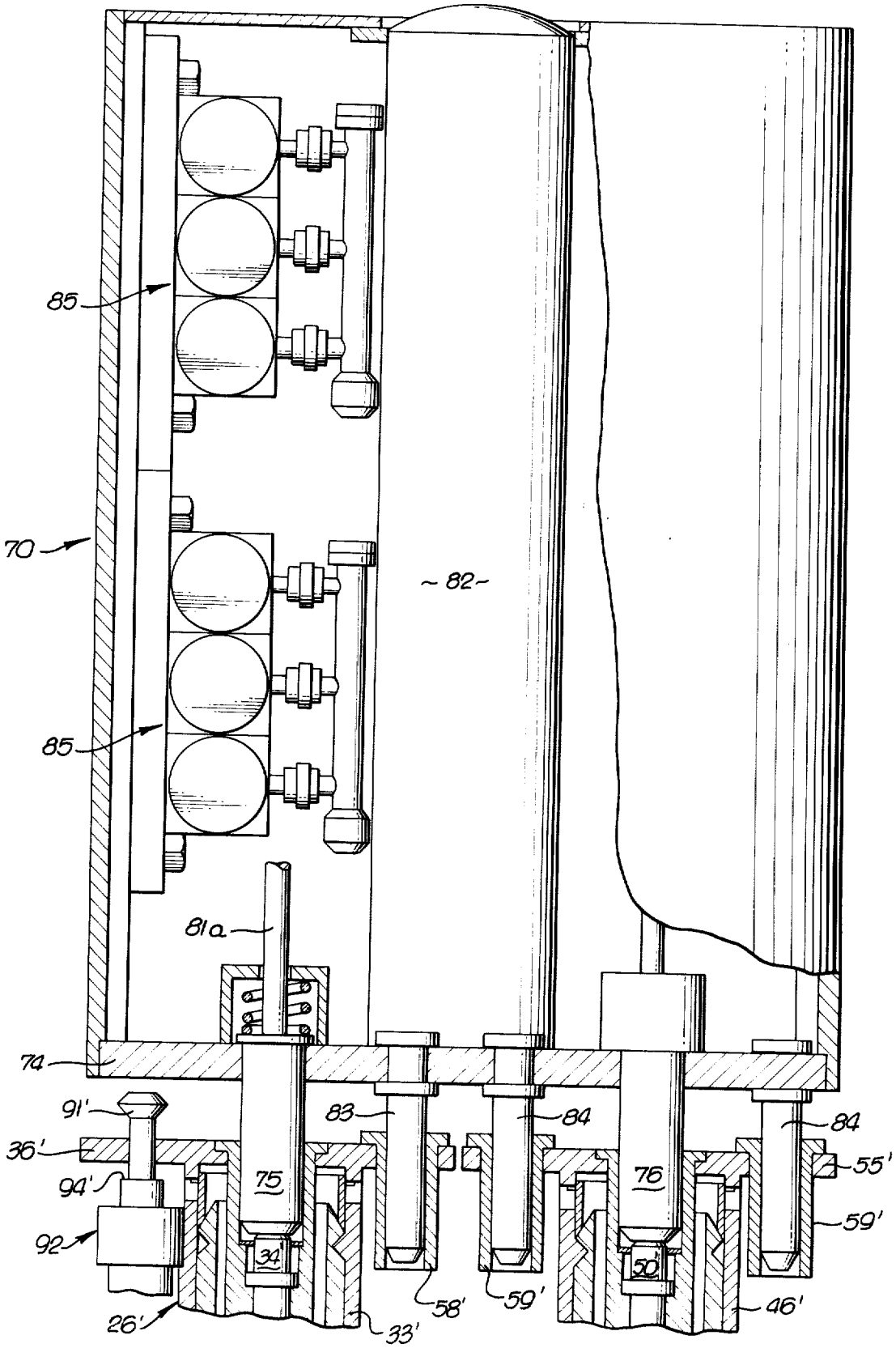
FIG. 12 is an enlarged side elevational showing of the pilot control valve package.

Turning to FIG. 12, the package 70 includes a base plate 74, from which third and fourth electrical connectors in the form of sockets 75 and 76 extend to connect with first and second electrical connector plugs 34' and 50' respectively; alternatively, if these dual plugs have been removed, the connections may be made to the first and second plugs 34 and 50, respectively. Suitable guide pins may be carried by plate 74 to interfit guide receptacles on plate 36' and alternately receptacles on plate 36.

Operative connection between electrical sockets 75 and 76 may be made directly, as by a crossover cable of which cable 81*a* may be considered as representative; or, the operative crossover connection may be made via electronic logic of which panel or board 82 is representative. Similarly, crossover third and fourth hydraulic connections 83 and 84 on the package 70 may be connected with hydraulic connections 58 and 59, respectively, as is clear from FIG. 13, or with connections 58' and 59' as is seen in FIG. 12, and direct crossover connections may exist between connections 83 and 84, or some of the crossover connection may include pilot valves in series therewith, such valves indicated at 85 in FIG. 12. Both valves and electronic logic are shown at 85 and 82 in FIG. 13. Thus, when the package 70 is in place, the electrical and hydraulic connections between the surface control panel 66 and the tree 41 have been established.

Subsequently, the package 70 may be retrieved upwardly if desired, the second connector means 40 may be retrieved, the first connector means 26 may be retrieved upwardly, and finally the locating pedestals 19 and 20 may be retrieved.

Referring to FIG. 11, the number 90 indicates a retrieval tool operable to couple onto the nipple 91' carried by the upper or dual first connector assembly 26', for upwardly retrieving the latter. Tool 90 may be lowered to the well head on a line 110 guided by guide lines 16 and 160 via suitable guide arms 31 as described. Similarly, the lower first connector assembly 26 may be retrieved by coupling of tool 90 onto nipple 91 integral with locking pin 39. Upward displacement of the pin unblocks latch 37*a*, allowing it to cam out of groove 38 as the connector 26 is pulled upwardly. Shoulder 94 on pin 39 engages top plate 36 to urge assembly 26 upwardly; Similarly, shoulder 94' on pin 39' engages plate 36' to urge assembly 26' upwardly.

The numeral 92 generally designates latching structure for the upper first connector 26' which is similar to latching structure 37*a*, 39*a*, 60, 61 and 62 previously described, and to cooperate with pin 39' in a similar manner.

I claim:

1. In the method of controlling a stack of underwater well head equipment, and wherein a locating means is preliminarily positioned at the well head, the steps that include a. separately lowering to the well head first and second connector means and effecting reception thereof by the locating means so that the first and second connector means are brought into generally upright laterally spaced apart relation and laterally spaced from the stack, as determined by the locating means, and b. subsequently lowering to the well head crossover third and fourth connector means and effecting generally vertical coupling thereof to the previously located first and second connector means respectively, for operatively interconnecting the first and second connector means via the crossover connector means.

2. The method of claim 1 wherein said coupling is effected by downwardly telescopically interfitting the third and fourth connector means with the first and second connector means, respectively.

3. The method of claim 1 including the step of guiding said lowering steps by means of common guide lines.

4. The method of claim 1 including the step of lowering a control line in the sea with the line attached to the first connector means.

5. The method of claim 4 including the step of lowering well head equipment to the underwater well head simultaneously with said lowering of the second connector means.

6. The method of claim 1 wherein said lowering steps include lowering first and second fluid pressure connector means in conjunction with lowering of first and second electrical connector means, respectively, lowering third and fourth fluid pressure connector means in conjunction with lowering of third and fourth electrical connector means, and wherein said coupling step is carried out by effecting generally vertical coupling of the third and fourth fluid pressure connector means with the first and second fluid pressure connector means, respectively, and generally vertical coupling of the third and fourth electrical connector means with the first and second electrical connector means, respectively.

7. The method of claim 6 wherein said lowering of said third and fourth electrical and fluid pressure connector means is carried out by lowering common crossover structure supporting said third and fourth electrical and fluid pressure connector means and also supporting fluid pressure valve means connected with at least one of said third and fourth connector means, and electrical actuator means connected with at least one of said third and fourth electrical connector means.

8. The method of claim 1 including the step of disconnecting from the first and second connector means said third and fourth electrical connector means supported on common structure by upwardly displacing said support structure.

9. The method of claim 8 that includes the subsequent step of upwardly retrieving at least one of said first and second connector means.

10. The method of claim 8 including the subsequent steps of upwardly retrieving said second and then said first connector means, and there after upwardly retrieving said locating means.

11. In apparatus for controlling a stack of underwater well head equipment through use of connector means to be operatively interconnected at the well head, a. locating means at the well head and having dual structure to downwardly telescopically receive said first and second connector means in laterally spaced relation, and b. said dual structure including a base and two upwardly projecting pedestals which are laterally spaced apart, c. first and second connector means removably downwardly telescopically received by said pedestals to be upwardly and independently retrievable therefrom, and d. said first and second connector means including electrical sockets which are upwardly exposed to downwardly telescopically receive electrical elements associated with crossover third and fourth connector means, respectively.

12. The apparatus of claim 11 wherein said locating means includes guide means for guiding said dual structure into a locating position at the well head to downwardly receive said first and second connector means, as aforesaid.

13. In apparatus for controlling a stack of underwater well head equipment through use of connector means to be operatively interconnected at the well head, a. locating means at the well head and having dual structure to downwardly telescopically receive said first and second connector means in laterally spaced relation, and b. first and second connector means removably downwardly telescopically received by said dual structure to be upwardly and independently retrievable therefrom, c. said dual structure including a base and two upwardly projecting pedestals which are laterally spaced apart, d. said locating means including guide means for guiding said dual structure into a locating position at the well head to downwardly receive said first and second connector means, as aforesaid, and e. crossover third and fourth connector means respectively removably and downwardly telescopically received by said first and second connector means.

14. The apparatus of claim 13 including a first guide arm connected with said first connector means and configured to interfit a vertical guide line.

15. The apparatus of claim 14 including a second guide arm connected with said second connector means and configured to interfit a vertical guide line.

16. The apparatus of claim 15 wherein said first and second connector means include first and second electrical connectors, respectively.

17. The apparatus of claim 16 wherein said first and second connector means also include first and second fluid connectors, respectively.

18. The apparatus of claim 17 including well head equipment lowered to the well head, the second connector means integral with said well head equipment.

19. The apparatus of claim 18 wherein said first and third connector means include intercoupled first and third electrical connectors, and said second and fourth connectors means include second and fourth intercoupled electrical connectors.

20. The apparatus of claim 19 wherein said first and third connector means also include intercoupled first and third fluid connectors, and said second and fourth connector means include second and fourth intercoupled electrical fluid connectors.

21. In apparatus for controlling a stack of underwater well head equipment through use of connector means to be operatively interconnected at the well head, a. locating means at the well head and having dual structure to downwardly telescopically receive said first and second connector means in laterally spaced relation, and b. first and second connector means removably downwardly telescopically received by said dual structure to be upwardly and independently retrievable therefrom, c. said locating means including guide means for guiding said dual structure into a locating position at the well head to downwardly receive said first and second connector means, as aforesaid, d. crossover third and fourth connector means respectively removably and downwardly telescopically received by said first and second connector means, e. each of said first and second connector means including dual connectors having vertically separable telescopic interconnection, each of the dual connectors configured to receive downward telescopic connection of one of said third and fourth connector means so that when one of the connectors is selectively separated from the other, said other connector is then presented to receive downward telescopic connection of said one of the third and fourth connector means.

* * * * *